United States Patent [19]

Riethmann et al.

[11] Patent Number: 4,832,111

[45] Date of Patent: May 23, 1989

[54] PROCESS FOR CASTING MOLTEN METAL

[75] Inventors: Max Riethmann, Ermatingen, Switzerland; Herbert Schilling, Erfstadt, Fed. Rep. of Germany

[73] Assignee: Georg Fischer AG, Schaffhausen, Switzerland

[21] Appl. No.: 162,331

[22] PCT Filed: Jun. 9, 1987

[86] PCT No.: PCT/CH87/00066

§ 371 Date: Feb. 16, 1988

§ 102(e) Date: Feb. 16, 1988

[87] PCT Pub. No.: WO87/07856

PCT Pub. Date: Dec. 30, 1987

[30] Foreign Application Priority Data

Jun. 17, 1986 [CH] Switzerland ..... 2442/86

[51] Int. Cl.[4] ..... B22D 35/04

[52] U.S. Cl. ..... 164/457; 164/37; 164/136; 164/335; 164/363

[58] Field of Search ..... 164/133, 136, 335, 363, 164/364, 457, 37

[56] References Cited

U.S. PATENT DOCUMENTS 3,256,571 6/1966 Lund ..... 164/244 X 4,205,721 6/1980 Jörn et al. ..... 164/335

FOREIGN PATENT DOCUMENTS 2823998 12/1979 Fed. Rep. of Germany ..... 164/363

*Primary Examiner*—Nicholas P. Godici

*Assistant Examiner*—J. Reed Batten, Jr.

*Attorney, Agent, or Firm*—Bachman & LaPointe

[57] ABSTRACT

Molten metal is poured from a melt container to a mold cavity defined by a molding material wherein the molding material in the region of the runner gate is of a higher density with respect to the rest of the molding material. A pouring lip protruding from the melt container seals in the region of the runner gate for delivering molten metal from the melt container to the mold cavity.

6 Claims, 1 Drawing Sheet

PROCESS FOR CASTING MOLTEN METAL

BACKGROUND OF THE INVENTION

The invention relates to a process and apparatus for casting molten metal wherein a casting mold containing molding material and a runner gate formed in the molding material is filled from a melt container having at least one pouring lip having a closable outlet.

It is known in the prior art to employ metering devices for controlling the flow of molten metal to a casting mold. In order to avoid the expense of a metering device, which also requires appropriate maintenance, German Patent DE-PS 2,811,055 discloses that a melt container can be placed with its pouring lip directly onto the casting mold or the mold material contained therein, with the interposition of a separating element therebetween. The separating element can be of various different designs, such as a funnel-shaped element, lying on the mold material in a corresponding depression and opening out at its lower funnel end into the gate of the casting mold. The separating element can also be pot-shaped or be designed in any other suitable manner and arranged in a a corresponding depression.

The object of the present invention is to simplify this casting process by eliminating separating elements while achieving a higher metal yield.

SUMMARY OF THE INVENTION

The foregoing object is achieved by the present invention wherein a process for casting molten metal from a melt container to a mold cavity defined by a molding material comprises providing a gate in the molding material for communicating a runner gate with the mold cavity, compressing the molding material in the region of the runner gate whereby the molding material in the region is denser with respect to the rest of the molding material, providing the melt container with a pouring lip having a closeable outlet, an outlet bore and a profiled lower surface projecting from the melt container, sealing the profiled lower surface on the molding material in the region of the runner gate, and feeding molten metal from the melt container through the outlet and said outlet bore in the pouring lip to the runner gate, gate and mold cavity such that the liquid level of the molten metal in the melt container decreases during the casting operation. The present invention includes an apparatus for carrying out the process.

BRIEF DESCRIPTION OF THE DRAWINGS

The invention is explained in greater detail below with reference to the drawings wherein.

DETAILED DESCRIPTION

Figure 2:
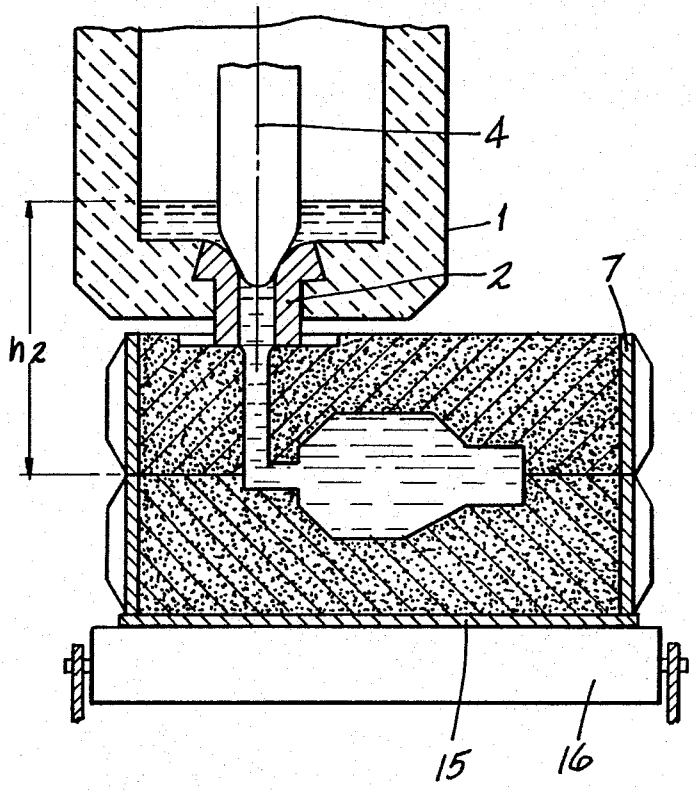
FIG. 2 shows the device shown in FIG. 1 in the position following the filling of the casting mold.
Figure 1:
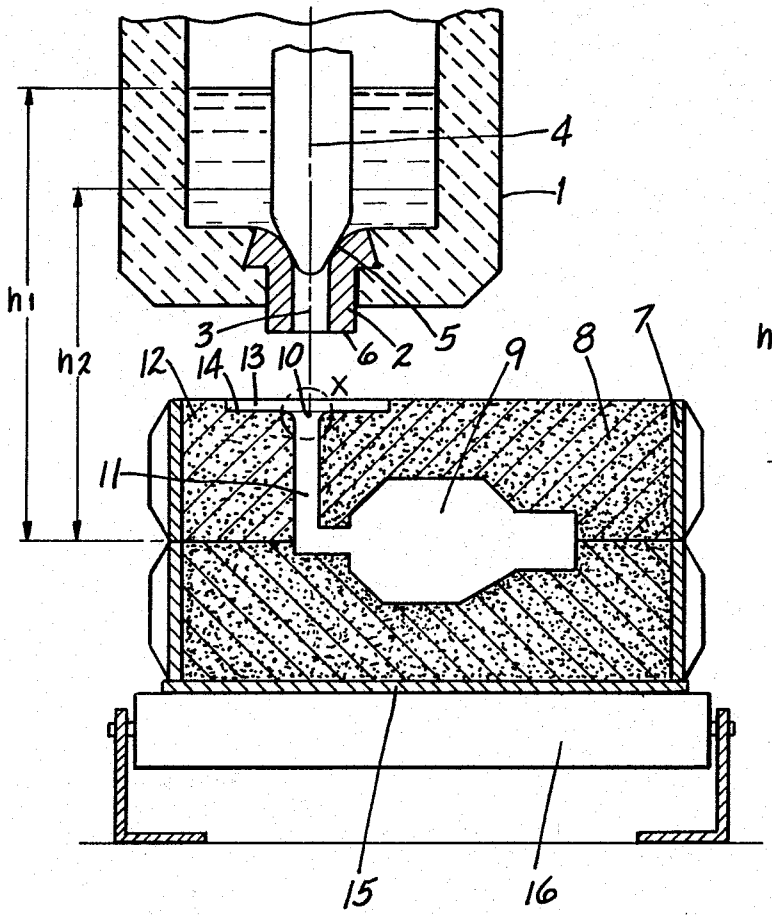
FIG. 1 shows a vertical section through the diagrammatically represented device for casting, in a position before the filling of the casting mold

According to FIGS. 1 and 2, the melt container 1 has at its base a pouring lip 2 having the outlet bore 3, which extends through the latter and, together with a stopper rod 4, which can be vertically displaced using a drive means (not shown in the drawing), forms the closeable outlet 5. At that end of the pouring lip 2 which projects downwards beyond the base of the melt container, the pouring lip 2 has a level or profiled lower surface 6.

The casting mold 7 contains mold material 8 in which a mold cavity 9 to be filled with molten metal is formed. The runner gate 10 at the top of the casting mold is connected to the mold cavity 9 via the gate 11. In a region 12 surrounding the runner gate 10, the molding material 8 is more highly consolidated. This extra consolidation is preferably effected by increased compaction of the mold material. A depression 13 is then formed in this more highly compacted region 12, preferably being produced by milling in or forming in and at the base of the depression having a surface 14 which is brought into surface contact with the lower side 6 of the pouring lip 2 during casting. To avoid excessive loading and possible breaking off of the mold material by the contact forces between the mold and the outlet in the recompacted area, the surface 14 of the depression 13 can and preferably is profiled or made such that it slopes slightly upwards and outwards. The cleanly worked or molded base of this depression 13 permits satisfactory sealing between the mold 7, 8 and the lower surface 6 of the pouring lip 2. After the parting of the mold and the melt container, the depression takes up the molten material remaining in the outlet bore 3 after the closure of the stopper 4. It also serves to receive any subsequent flow of iron. The cross-section of the outlet bore 3 is greater than the cross-section of the gate 11 so as to ensure that the entire cross-section of the gate is completely filled and to ensure that any failure to achieve an absolutely accurate connection between the outlet bore 3 and the gate 11 with mutually aligned axes, i.e. a slight lateral displacement, has no disadvantageous effect with respect to the filling operation.

The casting mold 7 is placed on a baseplate 15, which rests on a roller track 16. Means, which are not shown in the drawing, are used to move the melt container 1 in the vertical direction, making it possible to press the latter with adjustable force against the casting mold 7. It is of course conversely also possible for only the casting mold 7 to be arranged in a vertically moveable manner and to be pressed with a controllable amount of pressure against the melt container 1. Contact during the filling operation is maintained by a controlled amount of force. This force is set such that the resulting surface pressure is less than the strength of the mold so that the mold is not damaged. By reason of this controlled amount of force, the lower surface 6 of the pouring lip 2 and the surface 14 of the depression 13 are pressed against one another in a completely tight manner.

During casting, the casting mold is filled with the molten metal, with the liquid pressure of the molten metal dropping up to the end of the casting time. This means that prior to casting, the melt container 1 is filled with at least enough molten metal to fill the casting mold and the casting mold is filled with this at a pressure which drops as a result of the lowering of the level of molten metal. Controlled lowering of the level of molten metal can be achieved using the stopper rod 4. By means of the stopper rod 4 the outlet 5 is at least partially closed at a point in time shortly before the mold cavity 9 is completely filled, in order thereby to reduce the pressure surge caused by the moving molten metal.

The volume of the outlet bore 3 in the pouring lip 2 is comparatively small and the filling of the mold cavity 9 in the casting mold 7 can therefore be carried out by fully closing the outlet 5 because the gate 11 and the depression 13 take up the quantity of molten metal still present in the outlet bore 3 after closure and the system operates like a riser, the molten metal following up as a result of the shrinkage which occurs. In this way it is possible to ensure that there is no molten metal remaining above the gate 11, i.e. in comparison with hitherto known casting processes, that is processes using pouring cups, a smaller quantity of molten metal is required, leading very quickly to large savings.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. A process for casting molten metal from a melt container to a mold cavity defined by a molding material comprising:

(a) providing a gate in the molding material for communicating a runner gate with said mold cavity;

(b) compressing the molding material in the region of the runner gate whereby said molding material in said region is denser with respect to the rest of the molding material;

(c) forming a depression having a sealing surface in the region of the runner gate where said molding material is denser;

(d) providing said melt container with a pouring lip having a closeable outlet, an outlet bore and a profiled lower surface projecting from said melt container;

(e) sealing said profiled lower surface on said sealing surface of said depression in the region of the runner gate; and (f) feeding molten metal rom said melt container through said outlet and said outlet bore in said pouring lip to said runner gate, gate and mold cavity such that the liquid level of the molten metal in said melt container decreases during the casting operation.

2. A process according to claim 1 wherein one of the lower profiled surfaces of the pouring lip and the surface of the depression have a profile in order to shift the contact pressure from the region.

3. A process according to claim 1 including monitoring the change in the metal level in the melt container during the casting operation and closing the outlet when there is no longer any change in the metal level.

4. A process according to claim 1 including partially closing the outlet of the melt container prior to filling said mold cavity for reducing any pressure surge arising in the mold cavity due to the moving molten metal.

5. A process according to claim 1 including sealing the casting mold and the melt container by relative movement of the casting mold and the melt container in a vertical relation to one another.

6. A process according to claim 8 wherein said depression is formed by milling.

* * * * *